United States Patent [19]

Kimura

[11] Patent Number: 4,774,502

[45] Date of Patent: Sep. 27, 1988

[54] ENVIRONMENTAL ABNORMALITY DETECTION APPARATUS

[75] Inventor: Tetsuo Kimura, Tokyo, Japan

[73] Assignee: Nittan Co., Ltd., Tokyo, Japan

[21] Appl. No.: 77,858

[22] Filed: Jul. 27, 1987

[30] Foreign Application Priority Data

Aug. 14, 1986 [JP] Japan ..... 61-189512

[51] Int. Cl.[4] ..... G08B 17/10

[52] U.S. Cl. ..... 340/501; 340/629; 331/64

[58] Field of Search ..... 340/501, 500, 512–514, 340/628, 629; 331/64

[56] References Cited

U.S. PATENT DOCUMENTS 3,676,681 7/1972 Kobayaski ..... 340/629

4,538,137 8/1985 Kimura ..... 340/629

FOREIGN PATENT DOCUMENTS 47-32397 8/1972 Japan .

*Primary Examiner*—Donnie L. Crosland

*Attorney, Agent, or Firm*—Hill, Van Santen, Steadman & Simpson

[57] ABSTRACT

An environmental abnormality detection apparatus includes a detector for detecting environmental changes by monitoring physical changes in the environment and generating an output signal upon the detection of such an abnormality, a signal processor which generates an environmental abnormality signal based on the output of the detector, and a switching circuit connected between a pair of power source/signal lines. The apparatus further includes an oscillator and a control circuit which generates a signal for controlling the switching circuit obtained by the product of an output from the oscillator and the output of the signal processor. A power source is charged from the power source/signal lines, and supplies power to the detector, the signal processor and the oscillator.

4 Claims, 1 Drawing Sheet

ENVIRONMENTAL ABNORMALITY DETECTION APPARATUS

BACKGROUND OF THE INVENTION

1. Field of the Invention

The present invention relates to an environmental abnormality detection apparatus, in particular an apparatus for detecting a fire, gas leakage, a burglar, and the like.

2. Description of the Prior Art

Various types of environmental abnormality detection devices are known which include detectors specifically designed to monitor the presence of a particular environmental abnormality, such as the presence of a fire, gas, or unauthorized personnel.

A basic arrangement for a widely used fire detector is disclosed in Japanese Patent Publication No. 47-32397. The basic structure is reproduced as FIG. 3 herein. In this fire detector, a closed ion chamber 4 is connected in series with an open ion chamber 8. Smoke cannot enter the chamber 4, which has a pair of electrodes 1 and 2 and a radiation source 3. Smoke can enter the chamber 8, which has a pair of electrodes 5 and 6 and a radiation source 7. The ion chambers 4 and 8 in combination with a field effect transistor 9 form a smoke detector which detects changes in potential at a series connection point between the chambers 4 and 8. When smoke enters the open ion chamber 8, the smoke particles capture ion particles which have been ionized by the radiation source 7 thereby reducing the ion current flowing between the electrodes 5 and 6, and correspondingly increasing the impedance between those electrodes. The transistor 9 detects this increase in impedance as a change in potential. When the potential change thus detected by the transistor 9 exceeds a predetermined potential, set by a Zener diode 10, an SCR 11 is triggered to short-circuit power source/signal lines 12 and 13, thereby informing a receiver (not shown) of the detection of smoke.

As described above, this conventional fire detector uses an SCR or the like at the final stage so that operation is continued after an event such as the presence of smoke disappears. It is sometimes necessary, however, to cancel the short across the power source/signal lines immediately after the event disappears, and to provide a signal or some type of information indicating the disappearance of the event. In this case, the SCR cannot be simply replaced with a switching element such as a transistor which does not have the signal-holding functon of an SCR. This is because the power source/signal lines are shorted during a detection operation as described above. Since during this time power is no longer supplied to the electronic circuit, disappearance of the cause of the alarm signal cannot be monitored.

SUMMARY OF THE INVENTION

It is an object of the present invention to provide an environmental abnormality detection apparatus which can monitor the disappearance of an alarm event even when the power source/signal lines are shorted during a detection operation.

In accordance with the principles of the present invention, an environmental abnormality detection apparatus has a detector for detecting environmental changes by monitoring physical changes in the environment, and generation a detection signal corresponding to those changes. A signal processor receives the signal from the detector and generates an environmental abnormality signal in accordance therewith. A switching circuit is connected between a pair of power source/signal lines. The apparatus further includes an oscillator and a control circuit for the switching device. The control circuit forms a logical product from the output of the oscillator and from the environmental abnormality signal. A power source is also provided, which is charged from the power source/signal lines, and which supplies power to the detector, the signal processor, and the oscillator. In the environmental abnormality detection apparatus disclosed herein, when the environmental abnormality signal is generated the switching circuit is sychronized with the output from the oscillator through the control circuit so as to repeatedly short-circuit and open a connection across the power source/signal lines. In the short-circuited state, a receiver is informed of the generation of the abnormality signal. In the open state, the power source is charged to supply power to the detector, the signal processor and the oscillator, so that the detection operation can continue and thus generate a signal indicating when the alarm event has disappeared.

DESCRIPTION OF THE PREFERRED EMBODIMENTS

Figure 1:
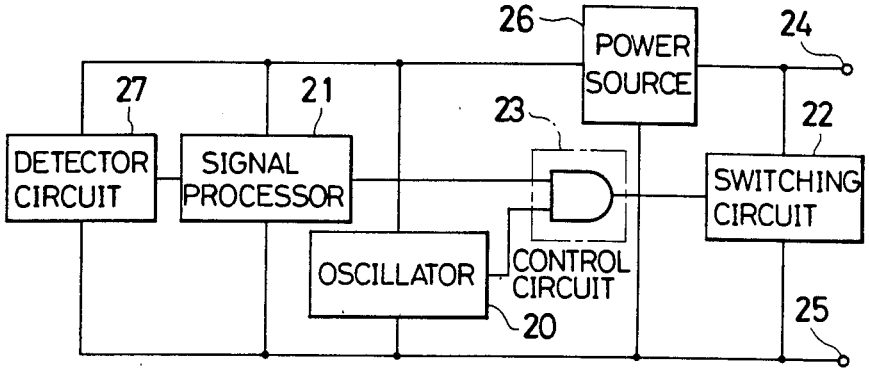
FIG. 1 is schematic diagram of an environmental abnormality detection apparatus constructed in accordance with the principles of the present invention.

The principles of operation of an environmental abnormality detection apparatus constructed in accordance with the principles of the present invention are generally shown in FIG. 1. The detection apparatus includes an oscillator 20, a control circuit 23, and a power source 26. The control circuit 23 forms a logical product as its output from the oscillator 20 and from an environmental abnormality signal generated by a signal processor 21. The power source 26 is charged through the power source/signal lines 24 and 25. The power source 26 supplies power to a detector 27, the signal processor 21 and the oscillator 20.

Figure 2:
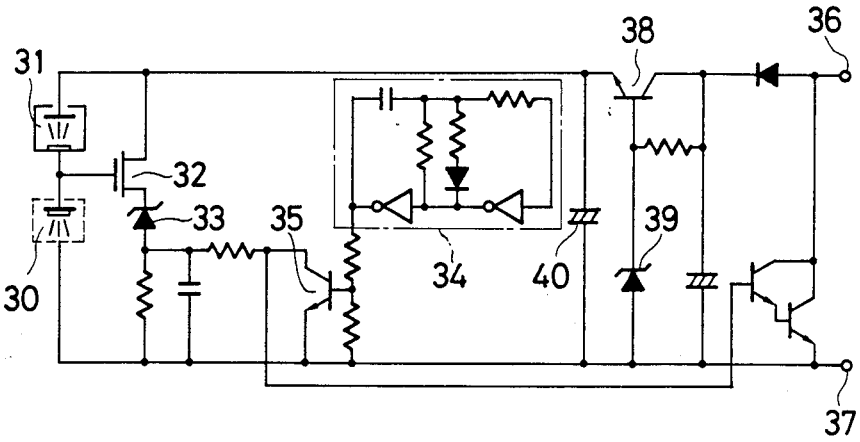
FIG. 2 is a schematic circuit diagram of the detection apparatus of FIG. 1 constructed in accordance with the principles of the present invention.
Figure 3:
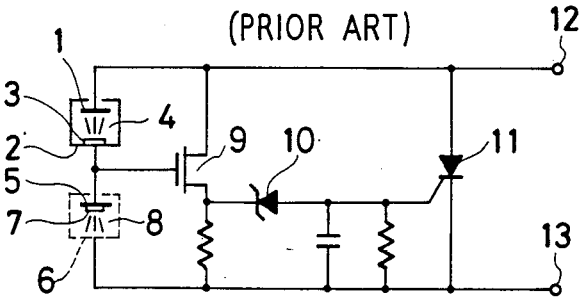
FIG. 3 (PRIOR ART)
FIG. 3 is a schematic circuit diagram of a known environmental abnormality detection apparatus.

An embodiment as shown in FIG. 2 wherein the abnormality detection apparatus of FIG. 1 is used in an ionized fire detector corresponding, except for the improvement disclosed herein, to the conventional detector described above. As shown in FIG. 2, the apparatus includes a smoke detector formed by an open ion chamber 30, a closed ion chamber 31, and a field effect transistor 32. When a potential change detected by the transistor 32 exceeds a predetermined potential set by a Zener diode 33, an environmental abnormality signal is generated. The field effect transistor 32 and the Zener diode 33 thus form a signal processor which generates the environmental abnormality signal as an output in accordance with the output received from a detector formed by the chambers.

An oscillator 34, consisting of an astable multivibrator is supplied with power from a power source to be described later (the specific connections not being shown in FIG. 2). The oscillator 34 is selected so as to oscillate at a relatively high frequency. A control circuit, which forms the logical product of an output from the oscillator 34 and from the environmental abnormality signal from the signal processor, is formed primarily by a transistor 35. The output of the control circuit is supplied to a switching circuit consisting of transistors so as to short-circuit the power source/signal lines 36 and 37. The power source/signal lines 36 and 37 are connected to the power source, which in this embodiment is a capacitor 40 which is charged through a fixed voltage circuit consisting of a transistor 38 and a Zener diode 39. The power source supplies power to the smoke detector, the signal processor, and the oscillator 34.

During normal operation, the power source is charged through the power source/signal lines 36 and 37, and the smoke detector is supplied with power therefrom to continue the detection operation. When smoke enters the smoke detector, and the output exceeds a predetermined value, the signal processor generates the environmental abnormality signal. The control circuit generates the logical product of the environmental abnormality signal and the output from the oscillator 34, and energizes the switching circuit to short-circuit the lines 36 and 37, thereby informing a receiver (not shown) of the detection of smoke. Because the output of the oscillator has an extremely short interval of logic "0" (when the output is at a high potential), the receiver can be operated as if the detector were continuously generating the detection signal as an output. The sensitivity of the receiver is accordingly selected at a low enough value to achieve this result, i.e., the receiver cannot have an extremely high sensitivity.

As described above, when the output of the oscillator 34 is at logic "0", the control circuit opens the switching circuit by the logical product function. Therefore the capacitor 40 of the power source is charged. Since the capacitor 40 is repeatedly charged in synchronism with the oscillation cycle of the oscillator 34, it maintains sufficient electric charge for operating the smoke detector, the signal processor, and the oscillator.

Because the smoke detector is supplied with power from the power source after it detects smoke, so as to maintain its detection function, its detection output is reduced when smoke concentration is reduced. When the detection output is reduced below a predetermined value, the signal processor stops generation of the environmental abnormality signal. Therefore the control circuit opens the switching circuit and maintains that circuit open, so that the receiver is informed of the disappearance of the detection signal.

In the above embodiment, an ionized fire detector was employed as the detector. Any other suitable type of detector may be used, however, such as an optical or thermal fire detector, or a gas leakage detector.

The environmental abnormality detection apparatus described above thus supplies power to the detector, the signal processor, and the oscillator, even when used with a receiver which is informed of the presence of an environmental abnormality by a short circuit across the power source/signal lines. Power to the detector is continued even after such a signal occurs. Because such a power supply need be provided only to the detector, the apparatus disclosed herein can be applied to existing equipment without substantial modification to that equipment.

Although modifications and changes may be suggested by those skilled in the art it is the intention of the inventor to embody within the patent warranted hereon all changes and modifications as reasonably and properly come within the scope of his contribution to the art.

I claim as my invention:

1. An environmental abnormality detection apparatus comprising:

detector means for detecting environmental changes by monitoring physical changes in the environment and generating an output signal corresponding to said changes;

a signal processor means for generating an environmental abnormality signal in dependence on the output from said detector means;

a switching circuit connected across a pair of power source/signal lines for opening a path across said signal lines or short-circuiting said signal lines;

an oscillator;

a control means for forming a logical product from the output of said oscillator and said environmental abnormality signal for controlling said switching means; and a power source connected across said power source/signal lines for supplying power to said detector means, said signal processor and said oscillator, whereby said detector is maintained operational by said power source immediately following the generation of an environmental abnormality signal.

2. An apparatus as claimed in claim 1, wherein said oscillator is an astable multivibrator.

3. An apparatus as claimed in claim 1, wherein said control means consists of an AND gate including a transistor.

4. An apparatus as claimed in claim 1, wherein said power source comprises a fixed voltage circuit and a capacitor, said capacitor being connected to said detector, said signal processor and said oscillator for supplying power thereto formed by an electric charge on said capacitor.

* * * * *